United States Patent [19]

Properzi

[11] Patent Number: 4,537,054

[45] Date of Patent: Aug. 27, 1985

[54] ROLLING UNIT FOR A BAR OR THE LIKE ROLLING MILL

[76] Inventor: Giulio Properzi, Via Pietro Cossa 1, Milano, Italy

[21] Appl. No.: 498,406

[22] Filed: May 26, 1983

[30] Foreign Application Priority Data

Jun. 18, 1982 [IT] Italy ..... 21935 A/82

[51] Int. Cl.[3] ..... B21B 13/10

[52] U.S. Cl. ..... 72/224; 72/238

[58] Field of Search ..... 72/194, 195, 224, 238

[56] References Cited

U.S. PATENT DOCUMENTS

| | | | |
|---|---|---|---|
| 3,142,208 | 7/1964 | Properzi | 72/224 |
| 3,861,187 | 1/1975 | Properzi | 72/224 |
| 3,987,657 | 10/1976 | Properzi | 72/224 |
| 4,377,941 | 3/1983 | Zacharias | 72/224 |

*Primary Examiner*—Lowell A. Larson

*Assistant Examiner*—Jorji M. Griffin

*Attorney, Agent, or Firm*—Guido Modiano; Albert Josif

[57] ABSTRACT

The invention relates to a rolling unit having three rollers with axes arranged at 120°, wherein the main roller shaft derives its motion from a drive and transmits it to the shafts of the other two rollers through bevel gears. To simplify the assembly and service procedures, as well as to improve the roller adjustment facilities, the main roller is carried on a supporting body which can be removably positioned on the unit casing to allow axial adjustment of the main roller. The respective shaft engages rotatively, but in an axially slidable manner, with a coupling shaft connected to the drive. The supporting body may be attached to the casing radially, thereby it becomes possible to assemble the main shaft, together with the roller, bearings, and gears, and then secure the supporting body on the casing.

3 Claims, 4 Drawing Figures

ROLLING UNIT FOR A BAR OR THE LIKE ROLLING MILL

BACKGROUND OF THE INVENTION

This invention relates to a rolling unit for a bar or the like rolling mill. More particularly, the invention relates to a rolling unit of the type including a supporting casing which contains the mill rollers and their supports, the bearings and seals which isolate an oil circuit from an emulsion circuit.

A rolling unit of this type is placed on a bed, generally in line with other units, and derives its motion from a drive through a clutch, usually of the dog type. The drive is constructed such that each unit will receive its motion at an accurately preset rpm according to the position it occupies along the rolling train.

The unit generally includes three rollers having axes arranged at 120° from one another, two of the rollers being driven rollers and one the main roller. The latter is mounted on a shaft which derives its motion from the drive through a clutch and transmits it to the shafts of the driven or secondary rollers through respective bevel gear pairs.

A rolling unit of this type is described, for example, in UK Patent No. 1,202,792.

The main shaft, which protrudes from the support casing to engage with the drive, is supported on bearings accommodated within bores in the support casing. With such a rolling unit, the rollers are assembled in the following manner.

The main shaft is first arranged with the bevel gear and bearing at the clutch end and then inserted partly through the casing; thereafter, the respective roller is lowered through an opening in the casing with a radial movement relatively to the shaft, the roller is slid over the shaft, and the shaft is pushed into position. Inserted next are the second bearing, second bevel gear, and locking members, which are all passed through the bore located at the remote end from the clutch.

The two secondary rollers, and respective bevel gears, are instead arranged on respective shafts supported on bearings which are provided in bores formed in a secondary support stand (also called "box") which is secured to the casing by means of screws, after it has been inserted in a completely assembled state into a seat specially formed in the casing.

This type of construction results, therefore, in a relatively difficult and time-consuming assembling procedure. It also exhibits some limitations as regards the roller calibration, i.e. fine position adjustment thereof in order that the surface of the rollers which will contact the rolled metal is arranged such as to provide a rolling section concentrated along the theoretical rolling axis and being exactly the same as preset by calculation.

With a rolling unit of the type described above, the main roller is mounted fixedly, namely it can be adjusted neither axially nor radially. The two secondary rollers are instead adjustable, both axially and radially by means of shims interposed between the bearings and box, and between the box and unit. However, the axial adjustment involves a first attempt, measurement, disassembly, replacement of shims, and then final assembling. Adjustment in the radial direction requires a less complicated but just as long disassembly procedure. In other words, a rolling unit of the type just described exhibits some important disadvantages when adjustment is required.

In U.S. Pat. No. 3,987,657, a less complicated arrangement for axially adjusting the secondary rollers has been proposed already, which affords adjustment from outside the rolling unit, without requiring roller disassembly. The rollers are, in fact, mounted on cylindrical mounts which can be shifted axially and have a peripheral thread with which a ring element engages whose rotation, achieved through a gearing means, produces an axial displacement of the respective roller. Radial adjustment is instead achieved by shimming, and accordingly, with relatively complex operations.

That approach, while affording definite advantages as regards roller axial adjustment capabilities, does not fully overcome the assembling difficulties, in particular of the main shaft and roller, and still requires long assembling and servicing times.

It should be considered, in fact, that the cited difficulties are not only encountered upon initial assembling, but also whenever it becomes necessary to replace worn out rollers and/or bearings; an operation this one which may have to be performed already after a few days' interval since the roller life may be limited in some cases to a matter of days.

SUMMARY OF THE INVENTION

It is a primary object of this invention to provide a rolling unit for a bar or the like rolling mill which, additionally to affording easier and quicker assembling and servicing of the mill rollers, also allows adjustment of all the rollers.

A further object of the invention is to provide a rolling unit as specified, which can facilitate replacement of worn rollers and permits such replacement to be carried out without disassembling any of the gears and bearings.

These and other objects, such as will be apparent hereinafter, are achieved by a rolling unit for a bar or the like rolling mill, comprising a support casing containing the mill rollers and respective supports, the bearings, and seals isolating an oil circuit from an emulsion circuit, the rollers having axes arranged at 120° from one another and one of said rollers being driven rotatively by a drive through a dog clutch, the unit being characterized in that the main drive roller is carried on a body removably positionable on the unit casing, said body being adjustable on said casing at least in the direction of the main roller axis and the shaft of said main roller engaging rotatively, but in an axially slidable way, with a coupling shaft driven by said drive.

Advantageously, the removable positioning of the carrier body on the casing allows the main roller to be assembled together with the shaft and gears and bearings, the body being secured to the casing at some later time, thereafter the roller is brought to an exactly adjusted position.

In a specially advantageous embodiment of the invention, all the rollers are mounted on an adjustable body, thus providing full adjustment capabilities, which adjustment may be effected through externally controlled camming means, or alternatively, by means of shims or wedges.

According to a further preferred embodiment of the invention, the mill rollers may be a two-piece construction, namely each roller may comprise a structural steel hub attachable to its respective driveshaft, and a peripheral ring of a special material which would have the rolling contour and be removably coupled to the hub. Thus, replacement of worn rollers may be effected in a peculiarly short time by simply replacing the peripheral ring, without taking down bearings and bevel gears.

BRIEF DESCRIPTION OF THE DRAWINGS

Further features and advantages of the invention will be more clearly understood from the following description of a preferred embodiment thereof, given herein by way of example only with reference to the accompanying drawings, where.

DESCRIPTION OF THE PREFERRED EMBODIMENTS

Figure 1:
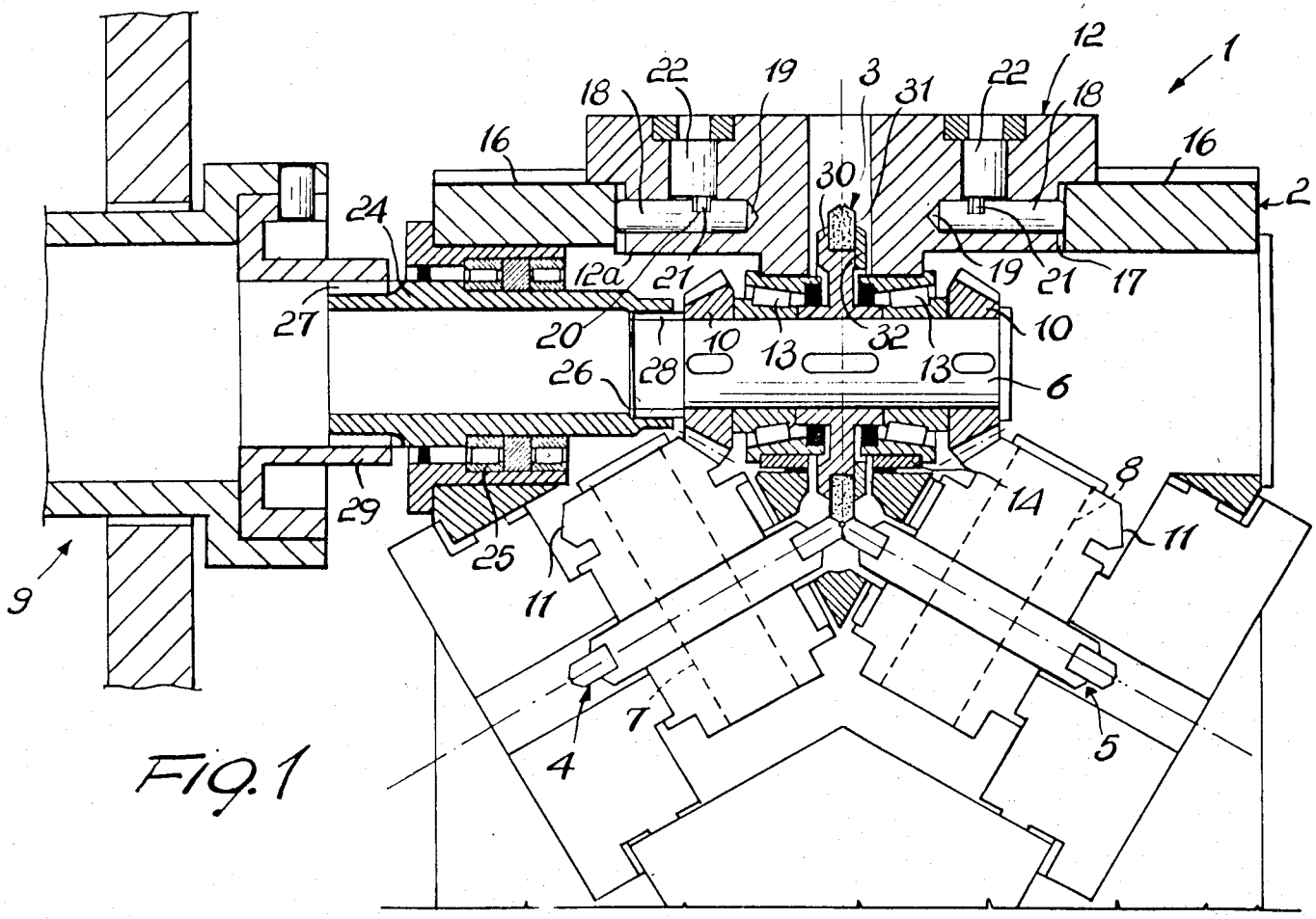
FIG. 1 is a sectional view of a rolling unit according to the invention, taken along a perpendicular plane to the rolling axis, shown in the unit being in particular the mounting structure for the main drive roller.

Making reference to the accompanying drawings, a rolling unit 1 according to the invention comprises a support casing 2, which may be a single piece casting or sheet metal welded construction and accommodates three mill rollers 3,4,5 therein, whose axes are arranged at 120° from one another on respective shafts 6,7,8. The drive roller or main roller 3 derives its motion from a drive 9, as will be explained hereinafter, and the driven or secondary rollers 4 and 5 derive their motion through pairs of bevel gears 10,11 attached respectively to the main shaft 6 and secondary shafts 7,8.

The main shaft 6 is carried in a supporting body or box 12 through bearings 13, which are secured to the box 12 by means of a cap 14 and screws 15. The box 12 can be positioned removably on the casing 2 of the rolling unit 1, being in particular adjustable in the direction of the axis of the main roller 3. To this aim, it is arranged to bear on shoulders 16 of the casing 2, and has a portion **12*a* which is accommodated with significant horizontal clearance in an opening 17 defined between the shoulders 16. With the shoulders 16 there engage locating pins 18, which are movable axially in seats 19 in the box 12 extending parallel to the axis of the main roller 3. On the outward side of the box 12, the pins 18 have transverse seats 20, wherein there engage eccentric ends 21 of adjustment shafts 22, arranged orthogonally with respect to the pins 18 and being reachable from outside of the box 12**.

It will be appreciated that a rotation of the shafts 22, as effected by means of suitable tools, results in an axial displacement of the pins 18 and, consequently, in adjusting the box 12 relatively to the casing 2 in the axial direction of the main roller 3, thereby the roller is adjusted in the direction of its own axis. Once that adjustment has been completed, the box 12 may be secured to the casing 2 through screws 23.

The above-described adjustment is made possible by the provision, between the main shaft 6 and drive 9, of a coupling shaft 24 carried rotatably in the casing 2 through bearings 25 and having at its ends respective dog clutches 26,27. With the dog clutch 26, there engages rotatively, but with allowance for an axial sliding movement, the correspondingly toothed end 28 of the main shaft 6, while the clutch 27 is rotatively engaged by the actuating member 29 of the drive 9.

Figure 2:
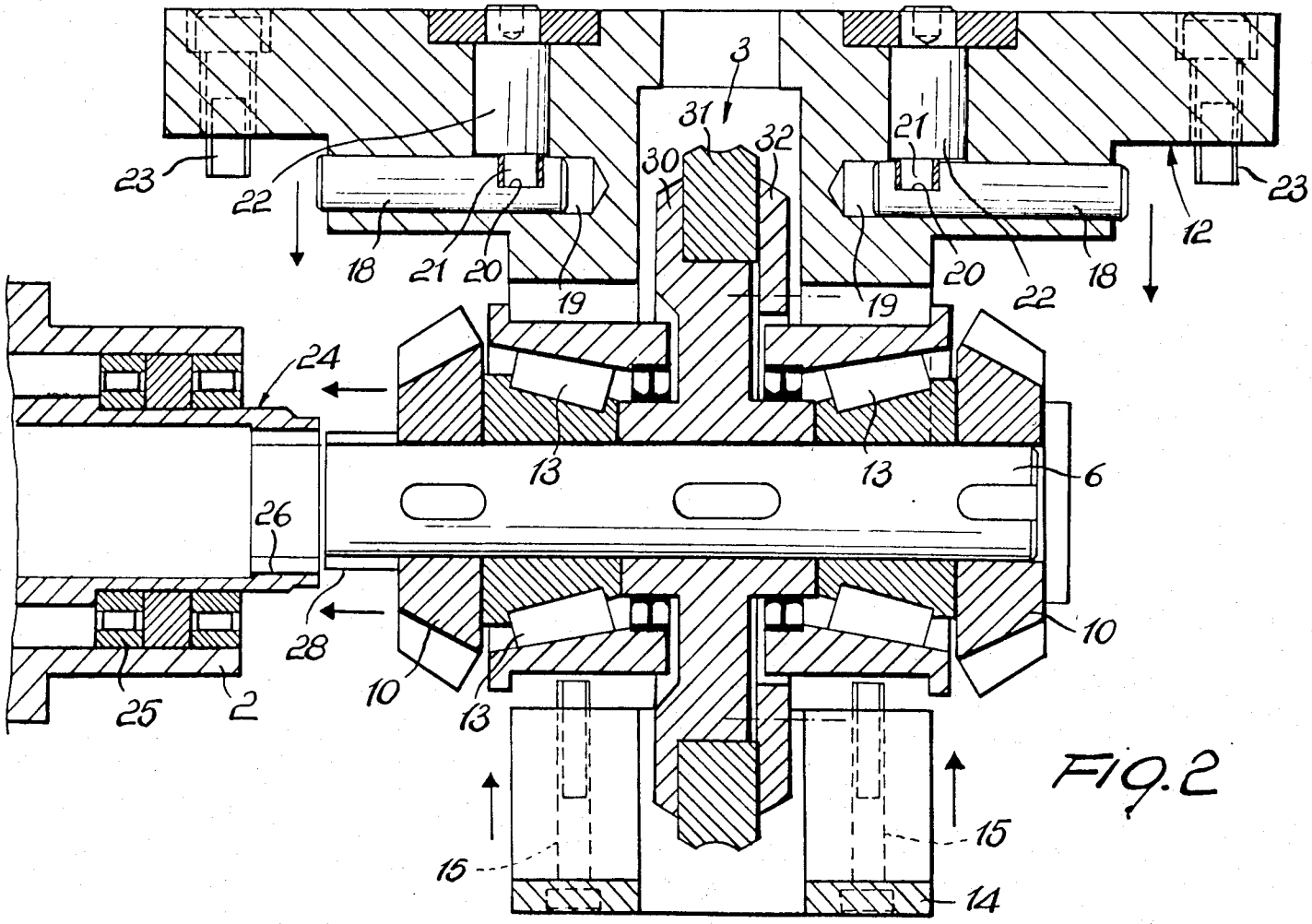
FIG. 2 shows the main roller supporting arrangement as taken apart prior to assembling.
Figure 3:
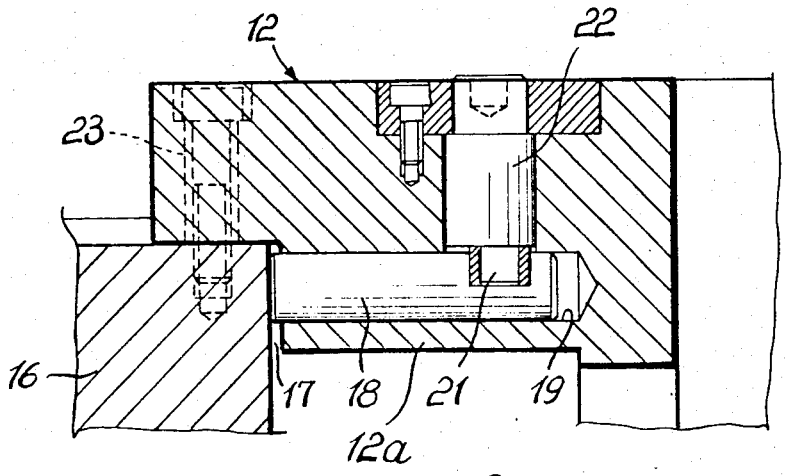
FIG. 3 is a detail view of the axial adjustment means.

Advantageously, as shown in FIGS. 1 and 2, the main roller 3 is formed in two pieces, i.e. a structural steel hub 30, keyed to the shaft 6, and a peripheral ring 31 of a special material, which has the rolling contour formed thereon and can be attached removably to the hub 30 through a clamping disk 32.

The construction just described makes the assembling of the main roller 3 easier because the main roller can be mounted first with the bearings 13 and gears 10 on the shaft 6, thereafter the whole assembly is placed in the casing 2 while inserting the end 28 into the coupling shaft 24, the cap 14 and box 12 is installed as indicated by the arrows in FIG. 2, and the box 12 is fastened in its definitive position on the casing 2. It will be appreciated that disassembling of the box 12 will also make replacement of the peripheral ring 31 easier without disturbing the bearings 13 and gears 10.

Of course, and as suggested in FIG. 1, the secondary rollers 4 and 5 may also be a two-piece construction, similar to the main roller 3, and carried in respective boxes of the type of box 12, with individual adjustment means of the type of that described for the box 12, so as to be adjustable in the directions of their axes.

Figure 4:
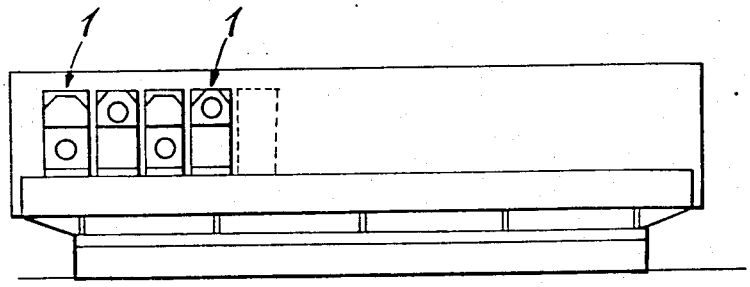
FIG. 4 shows a rolling mill incorporating a plurality of rolling units according to this invention.

The rolling unit 1 may, of course, have the main shaft and roller located at the bottom instead of at the top. More particularly, in a rolling mill comprising rolling units according to this invention, there may be advantageously provided alternately units having their main roller at the bottom and units having their main roller at the top, as shown in FIG. 4. A unit and rolling mill according to the invention would be specially useful for rolling wire rod, bars, and metal pipes of zinc, aluminum, copper and respective alloys, as well as of ferrous materials.

It is to be understood that the various rollers may also be adjustable radially, i.e. orthogonally with respect to the rolling axis, e.g. by placing shims between the respective boxes and casing 2, or through an adjustment shaft arrangement of the same type as described with reference to axial adjustment, compatibly with the backlash of the clutch 26 for the main roller.

I claim:

1. A rolling unit for a bar or the like rolling mill comprising:

a support casing, mill rollers having axes arranged at 120° from one another and including a main drive roller having a shaft, supports and bearings for said rollers and seals for isolating an oil circuit from an emulsion circuit; said mill rollers with respective supports, and said bearings and seals being contained in said support casing;

a body removably positionable on the unit casing and carrying the main drive roller; said body being removably positionable in a direction radial to said main drive roller and being adjustable on said casing, at least in the direction of the axis of said main roller;

a coupling shaft driven by a drive and having dog clutch means on at least one end thereof; said shaft of said main drive roller having an end thereof with other dog clutch means for mutual rotatory engagement, but in an axially slidable way, with said dog clutch means of said coupling shaft.

2. A rolling unit as claimed in claim 1, wherein said support casing has means defining an opening facing said supporting body, said means including two spaced apart shoulders and wherein said supporting body bears on said two shoulders of said casing, and has a portion accomodated with clearance in said opening defined between said shoulders and adjusting pins received in seats in said supporting body, said shoulders being engaged by said adjusting pins extending parallel to the axis of the roller carried on said supporting body and wherein said adjusting pins are movable axially and securable in said seats for adjusting said supporting body in the direction of said roller axis.

3. A rolling unit as claimed in claim 2, wherein said adjusting pins have transverse seats engaged by eccentric ends of adjustment shafts extending orthogonally with respect to said pins and adapted for operation from the outside of said supporting body for axially adjusting the mill roller carried on said supporting body.

* * * * *